US006074176A

United States Patent [19]

Conkin et al.

[11] Patent Number: 6,074,176

[45] Date of Patent: Jun. 13, 2000

[54] PROPORTIONAL PRODUCT INJECTION CIRCUIT WITH TWO DIAPHRAGM VALVES

[76] Inventors: David W. Conkin, 48911 Chaumox Road; Burns L. Matkin, 47520 Fairley Road, both of Boston Bar, British Columbia, Canada, V0K 1C0

[21] Appl. No.: 08/838,752

[22] Filed: May 16, 1997

Related U.S. Application Data

[63] Continuation of application No. 08/609,009, Feb. 29, 1996, abandoned, which is a continuation of application No. 08/326,217, Oct. 20, 1994, abandoned.

[51] Int. Cl.[7] ..... F04B 49/00

[52] U.S. Cl. ..... 417/303; 417/188; 137/100; 137/569; 169/14; 169/15

[58] Field of Search ..... 417/303, 296, 417/307, 302, 188, 189, 191; 169/13, 14, 15, 61, 63; 137/100, 569, 893; 251/61.1

[56] References Cited

U.S. PATENT DOCUMENTS

| | | | |
|---|---|---|---|
| 1,178,222 | 4/1916 | Earl | 137/100 |
| 1,762,706 | 6/1930 | Wallace | 137/100 |
| 1,977,171 | 10/1934 | Clithero | 137/569 |
| 2,992,084 | 7/1961 | Shropp | 137/100 |
| 3,047,003 | 7/1962 | Gurney | 169/15 |
| 3,115,158 | 12/1963 | Sheppard | 169/14 |
| 3,149,474 | 9/1964 | Goodman | 417/189 |
| 3,557,811 | 1/1971 | Livingston | 137/7 |
| 3,900,043 | 8/1975 | Bowen et al. | 169/14 |
| 4,037,664 | 7/1977 | Gibson | 169/15 |
| 4,336,820 | 6/1982 | Jorgensen et al. | 137/100 |
| 4,370,102 | 1/1983 | Sasaki et al. | 417/296 |
| 4,526,234 | 7/1985 | Little | 169/15 |
| 4,681,297 | 7/1987 | Mertz | 137/599 |
| 4,722,358 | 2/1988 | Christensen | 169/15 |
| 5,009,244 | 4/1991 | Grindley et al. | 169/15 |
| 5,165,442 | 11/1992 | Fiala . | |
| 5,188,184 | 2/1993 | Northill | 169/22 |
| 5,255,747 | 10/1993 | Teske et al. | 169/15 |
| 5,329,555 | 7/1994 | Gensler et al. | 137/100 |

FOREIGN PATENT DOCUMENTS

| | | | |
|---|---|---|---|
| 318646 | 6/1989 | European Pat. Off. | 169/15 |
| 912657 | 7/1949 | Germany | 169/15 |
| 1367983 | 1/1988 | U.S.S.R. | 169/15 |
| 2216294 | 1/1992 | United Kingdom | 169/14 |

*Primary Examiner*—Ted Kim
*Attorney, Agent, or Firm*—Elbie R. de Kock

[57] ABSTRACT

A proportional fluid injector apparatus utilizing foaming agents. A pump is connected to a foaming agent and is operably connected to a differential proportional valve having a venturi. A first diaphragm control valve is operably connected between the pump and the venturi. A second diaphragm control valve is operably connected between the downstream and upstream sides of the pump and is also connected to a pilot line connected upstream of the venturi. The spring pressure exerted on the diaphragm in the first control valve is such that excess fluid from the pump returns upstream of the pump when the downstream pressure in the pump exceeds a predetermined value.

8 Claims, 4 Drawing Sheets

PROPORTIONAL PRODUCT INJECTION CIRCUIT WITH TWO DIAPHRAGM VALVES

This application is a continuation of U.S. patent application Ser. No. 08/609,009 filed Feb. 29, 1996 now abandoned, which is a continuation of U.S. patent application Ser. No. 08/326,217, filed Oct. 20, 1994, now abandoned, the contents of each of the aforementioned applications being incorporated herein by reference.

INTRODUCTION

This invention relates to a product injection method and apparatus and, more particularly, to a product injection method and apparatus for use with a wide range of injection rates of primary fluid which can be used in a foaming apparatus.

BACKGROUND OF THE INVENTION

Product injection apparatuses are, of course, well known for combining a first product such as a foaming agent with a primary fluid such as water. In fire fighting, for example, the use of a foaming agent is used to reduce the oxygen supply to the fire which hastens its termination.

Heretofore, product injection apparatuses used venturi pressure to draw a product from a reservoir into a primary fluid line. The system, however, worked well over only a limited venturi inlet range. Other apparatuses have not been able to quickly and efficiently switch between different products and the system must be shut down to replenish or substitute another product supply. Other apparatuses may be limited in the amount of product injected into the primary fluid and the pump may be of the fixed RPM type which does not allow increased product injection if the primary flow is increased. Other systems are unnecessarily complex with the result that field servicing may be difficult and, concomitantly, expensive.

SUMMARY OF THE INVENTION

According to the invention, there is provided proportional first injector apparatus comprising a first source of foaming agent, a fluid source of water operable to pass to a venturi, a pump connected to said first source of foaming agent, said pump being operably connected to said venturi, a first control valve operably connected between said pump and said venturi, a second control valve operably connected between the downstream and upstream sides of said pump and further being connected to a pilot line connected to said venturi, said second control valve being located such that the spring pressure exerted on the diaphragm in said second control valve by said pressure of said pump is such that said second control valve allows fluid to return to said upstream outside of said pump when the downstream pressure in said pump exceeds a predetermined value.

BRIEF DESCRIPTION OF THE DRAWING

A specific embodiment of the invention will now be described, by way of example only, with the use of drawings in which:

FIG. 3C is a diagramatic cross-sectional view of the first diaphragm valve illustrating the fluid flow therethrough with the product flow injection on.

DESCRIPTION OF SPECIFIC EMBODIMENT

Figure 1:
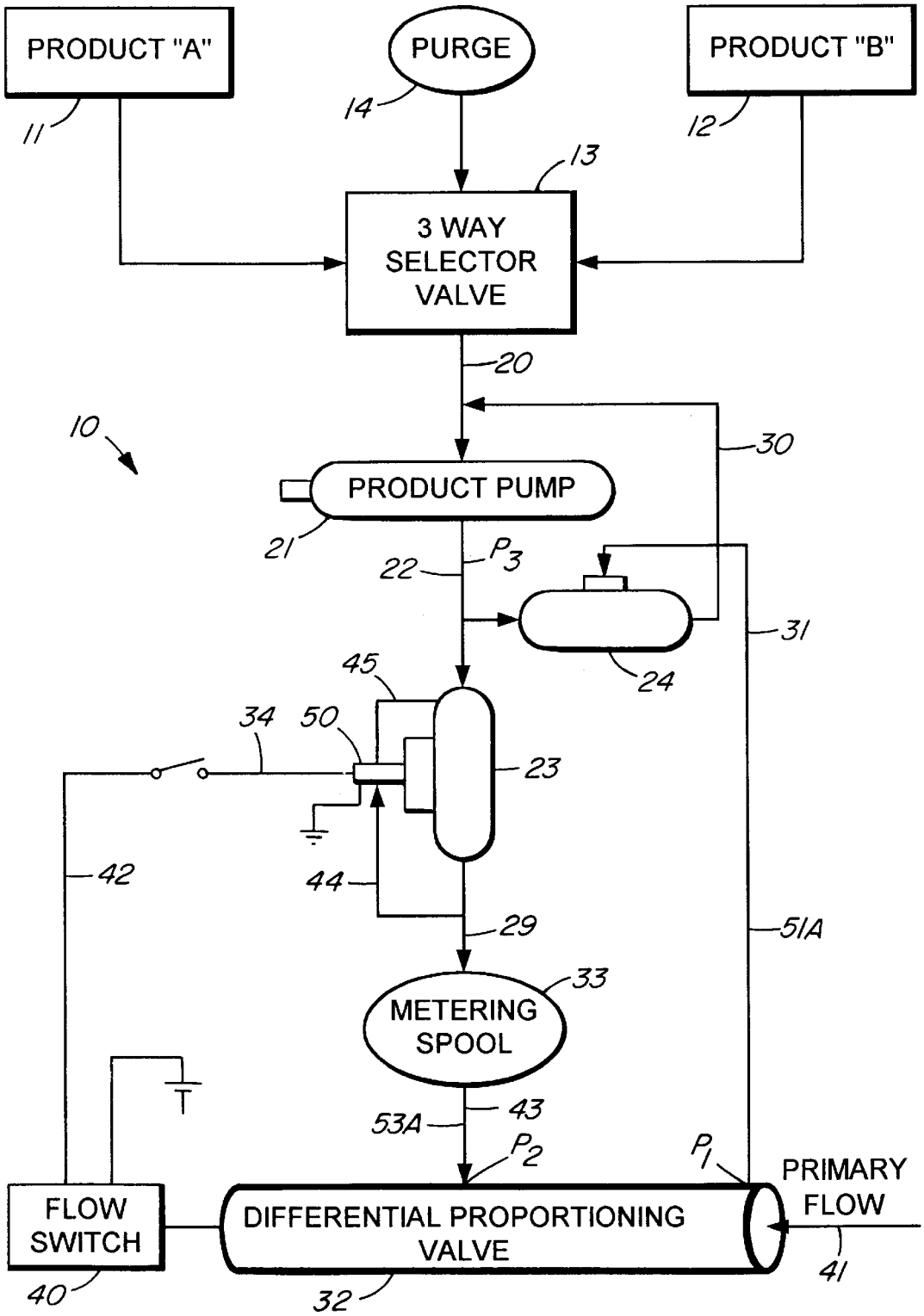
FIG. 1 is a diagramatic schematic view of the fluid circuit according to the invention.
Figure 2:
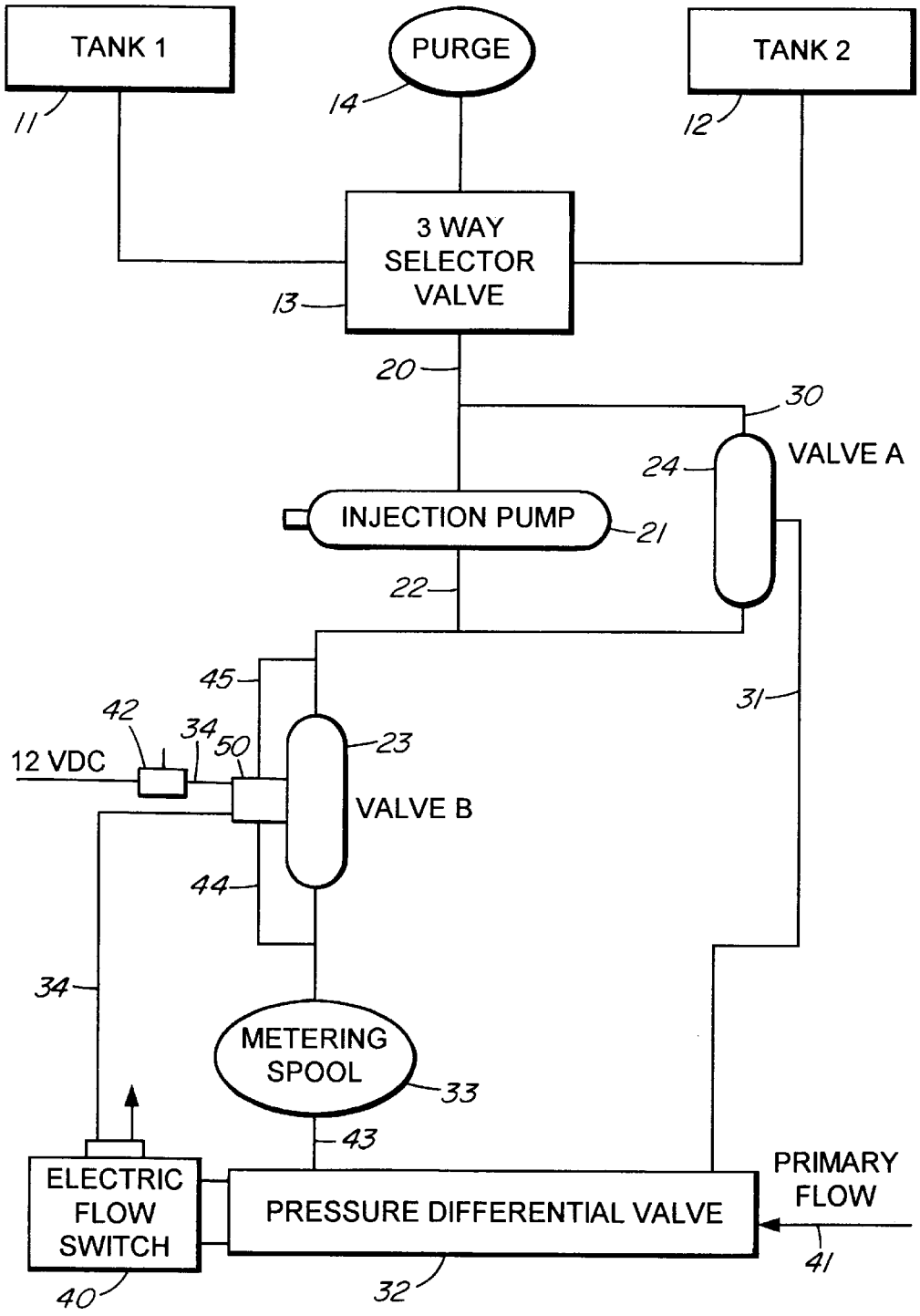
FIG. 2 is a view similar to FIG. 1 but illustrating the circuit in component form.

Referring to FIGS. 1 and 2, a product injection proportioning circuit is generally illustrated at 10. It comprises two sources of product 11, 12, respectively, which may be individual foaming agents such as the type used in fire fighting.

The product sources 11, 12 are connected to a selector valve 13 which is operable to select either of the product sources 11, 12. When desired, a purge source 14 may be used to clean the system.

The downstream line 20 of the selector valve 13 is connected to a product pump 21. Product pump 21 is of the variable r.p.m. type. Its speed may be increased or decreased as desired by the operator.

The downstream line 22 of product pump 21 is connected to first and second diaphragm type control valves 23, 24, respectively. First and second diaphragm valves 23, 24 are mounted in parallel with the outlet or return line 30 of second diaphragm valve 24 being connected to the inlet or upstream line 20 of pump 21. A pilot line 31 extends from the second diaphragm valve 24 to a differential proportional valve 32 containing a venturi as will be described in greater detail.

First control valve 23 has an outlet line 29 which passes to a metering spool 33. Electrical solenoid control lines 34 extend from control valve 23 to a flow switch 40 and to an electric switch 42 as will also be described. The downstream line 43 of metering spool 33 passes directly to the differential proportioning valve 32.

The pilot line 31 of second diaphragm valve 24 is connected upstream of the venturi (not illustrated) in the differential proportional valve 32. Thus, as the flow from the primary flow line 41 entering the differential proportioning valve 32 increases or decreases, pilot line 31 will sense such pressure change. The metering spool 33 will provide a predetermined mix of product from either the product sources 11, 12 per quantity of primary fluid flow from line 41 into the differential proportional valve 32.

OPERATION

In operation, the operator will initially select the correct product from product source 11 or product source 12, as desired, with the use of the selector valve 13. The intended mixture rate of the product with the primary fluid will also be known and metering spool 33 will be set accordingly.

The primary fluid flow through line 41 will then be initiated to the differential proportioning valve 32 and the operation of pump 21 commences. Switch 42 is operated to allow the injection of fluid to metering line 29 which results in flow through valve 23 to metering spool 33 with the valve 23 in the configuration shown in FIG. 3C and, thence, in the correct proportion according to the primary fluid flow in line 41 to the differential proportioning valve 32 through line 43.

The pressure in pilot line 31 is the pressure sensed in the differential proportioning valve 32 upstream of the venturi (not illustrated) and this is sensed by second diaphragm or flow bypass control valve 24. This is the primary flow pressure.

As the primary flow rate varies, differential flow pressure varies as a directly proportional function. The diaphragms in first and second diaphragm control valves 23, 24 are acted on by fixed closing springs exerting a known fixed and equal force. The outlet pressure product of pump 21 is of a magnitude which at all times is greater than the pressure in line 31. The pressure in line 22 is the pressure in line 31 plus additional pressure induced through the spring force acting on diaphragm in control valve 24. The pressure in line 29 becomes equal to the pressure in line 31 through the action of spring force acting on the diaphragm in valve 23 and the feedback pressure in line 29. There is now balanced pressure in lines 29, 31 which vary directly as primary flow pressure varies with primary flow rate.

The product entering metering spool 33 is at upstream primary flow pressure as sensed by pilot line 31. Metering spool 33 is designed to meter flow rate as a function of pressure differential across metering spool 33.

Proportioning valve 32 is designed to produce a known pressure differential between the port sensed by pilot line 31 and the port where line 43 enters valve 32. This varies proportionally with primary flow within maximum and minimum flow rate design specifications of valve 32. As flow rate increases so does the differential pressure across valve 32.

As pressure differential varies between the ports across valve 32, the pressure differential across metering spool 33 also varies through the interaction of valves 23, 24 causing proportionally more or less product injection into the primary flow stream.

As the pressure and flow increase in the primary line 41, the bypass through valve 24 decreases thereby causing pressure and corresponding flow rate increases through valve 23 and metering spool 33.

Figure 3A:
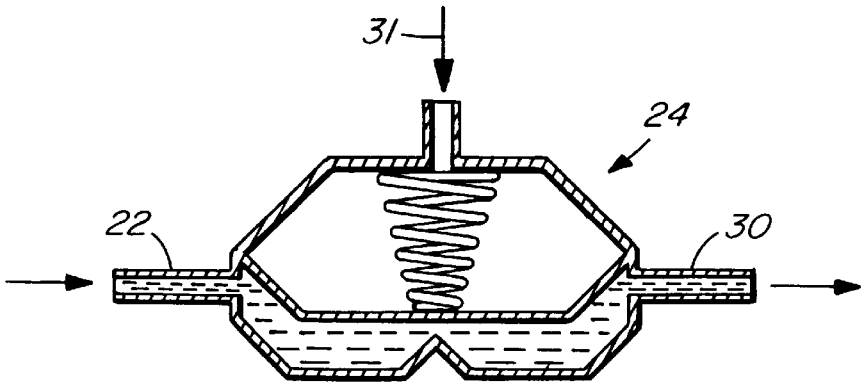
FIG. 3A is a diagramatic cross-sectional view of the second diaphragm valve according to the invention.
Figure 3B:
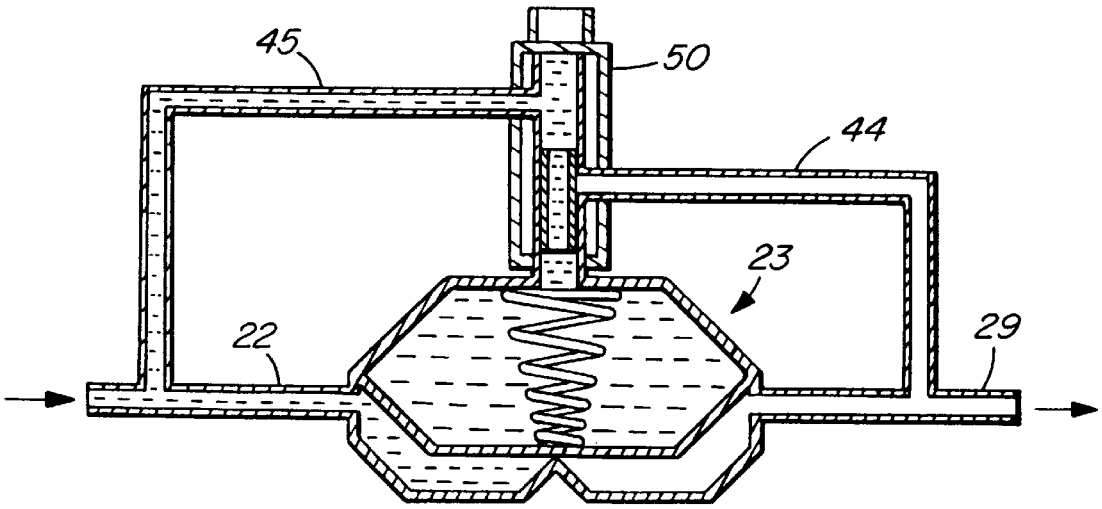
FIG. 3B is a diagramatic cross-sectional view of the first diaphragm valve illustrating the fluid flow therethrough with the product flow injection off.
Figure 3C:
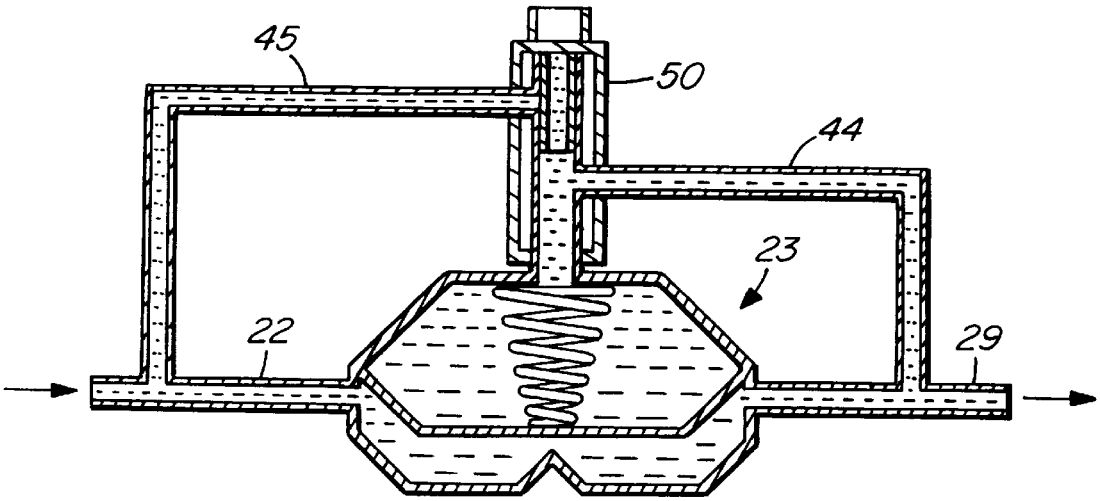

In the event it is desired to terminate injection flow from valve 23 to pressure differential valve 32, while allowing primary fluid flow to continue, switch 42 is operated which will initiate operation of the solenoid 50 to the condition illustrated in FIG. 3B. This will terminate flow in line 29 to metering spool 33. In the event flow is terminated through pressure differential valve 32 by electric flow switch 40, solenoid 50 will likewise be operated and injection flow through line 29 to metering spool 33 will also be terminated with valve 23 again being in the configuration shown in FIG. 3C.

Many modifications will readily occur to those skilled in the art and while a specific embodiment of the invention has been described, such description should be taken as illustrative of the invention only and not as limiting its scope as defined in accordance with the accompanying claims.

What is claimed is:

1. Fluid injector apparatus for proportionately injecting a secondary fluid, flowing in a secondary fluid flow line, into a primary fluid, flowing in a primary fluid flow line, responsive to a pressure differential between first and second locations along said primary fluid flow line, said first location being upstream of said second location, said second location being the point at which said secondary fluid is injected into said primary fluid flow line, comprising;

a pump in said secondary fluid flow line;

a flow through variable control valve having a pilot connection to said primary fluid flow line for sensing the pressure at said first location and being operatively connected to said secondary fluid flow line in a bypass line so as to redirect a portion of said secondary fluid flow from a location downstream of said pump to a location upstream of said pump and to cause the pressure at said downstream location to be substantially equal to the pressure at said first location, said flow through variable control valve regulating the pressure in said secondary fluid flow line responsive to the pressure at said first location along said primary fluid line; and a further variable control valve in said secondary fluid flow line operatively connected downstream of said pump to said primary fluid flow line and having a pilot connection to a location in said secondary fluid flow line downstream of said further variable control valve for sensing the pressure at said second location, said further variable control valve applying a back pressure on said secondary fluid flow line responsive to the pressure at said second location.

2. The apparatus according to claim 1 wherein said further variable control valve is a first diaphragm valve including a flow through chamber and a dead head pilot chamber, said further variable control valve being connected between said pump and said second location along said primary fluid flow line for effecting said sensing of the pressure at said second location and said further variable control valve pilot connection comprises a first connecting line between said pilot chamber and the secondary fluid flow line downstream of the first diaphragm valve for applying the back pressure on the secondary fluid flow line.

3. The apparatus according to claim 2, wherein said variable control valve, other than said further valve, comprises a second diaphragm valve which is connected between the upstream and downstream sides of said pump and said variable control valve pilot connection comprises a line connecting the head of the second diaphragm valve with the primary fluid flow line at said first position.

4. The apparatus according to claim 3, further comprising a differential proportioning valve having a high pressure port and a low pressure port, which valve is connected in line with said primary fluid flow line, said first and second locations along said primary fluid flow line, respectively, being defined by the high and low pressure ports of the differential proportioning valve and wherein the differential proportioning valve is operable to produce a pressure differential across the high and low pressure ports which is proportional to the flow rate of the primary fluid in the primary fluid flow line.

5. The apparatus according to claim 4, further comprising a metering valve in said second fluid flow line between said first diaphragm valve and the low pressure port of said differential proportioning valve.

6. The apparatus according to claim 5, further comprising a second connecting line between the head of the first diaphragm valve and the secondary fluid flow line upstream of the first diaphragm valve and a switching valve for closing either the one or the other of said first and second connecting lines.

7. The apparatus according to claim 6, wherein said switching valve comprises an electric three-way solenoid valve.

8. The apparatus according to claim 6, further comprising a flow sensitive switch on said differential proportioning valve for closing said second connecting line for terminating flow of the secondary fluid when primary fluid flow through said primary fluid flow line is terminated.

* * * * *